US005664262A

United States Patent [19]

Cominsky

[11] Patent Number: 5,664,262

[45] Date of Patent: Sep. 9, 1997

[54] TRANSPORT HOOD FOR PROTECTING CONVEYING PERSONNEL

[76] Inventor: John Charles Cominsky, 259 N. Hwy. 161, Clover, S.C. 29710

[21] Appl. No.: 415,683

[22] Filed: Feb. 16, 1996

[51] Int. Cl.[6] ..... A41D 13/00; A42B 1/04

[52] U.S. Cl. ..... 2/202; 2/206; 2/9; 128/857

[58] Field of Search ..... 2/202, 205, 206, 2/174, 9, 204, 171, 203, 173, 4, 417, 424, 457, 410; 128/857, 201.25

[56] References Cited

U.S. PATENT DOCUMENTS

| | | | |
|---|---|---|---|
| 128,451 | 7/1872 | Ackerman | 2/202 |
| 806,099 | 12/1905 | Boehm | 2/202 |
| 1,186,703 | 6/1916 | Sullivan | 2/202 |
| 1,504,100 | 8/1924 | Danubio | 2/174 |
| 1,678,649 | 7/1928 | Renault | 2/206 |
| 2,184,240 | 12/1939 | McInnis | 2/174 |
| 2,191,589 | 2/1940 | Sacks | 2/174 |
| 2,355,283 | 8/1944 | Diss | 2/174 |
| 2,446,122 | 7/1948 | Bills | 2/174 |
| 2,477,437 | 7/1949 | Borowick | 2/174 |
| 2,869,132 | 1/1959 | Drummond | 2/174 |
| 3,241,155 | 3/1966 | Phillips | 2/9 |
| 3,582,989 | 6/1971 | Fassbender | 2/205 |
| 3,789,839 | 2/1974 | Lund et al. | 2/206 |
| 4,589,408 | 5/1986 | Singer | 2/205 |
| 4,698,853 | 10/1987 | Walton | 2/174 |
| 4,805,639 | 2/1989 | Dial et al. | 2/9 |
| 4,887,316 | 12/1989 | Morandini | 2/202 |
| 4,979,236 | 12/1990 | Merrill et al. | 2/202 |
| 5,146,622 | 9/1992 | Blutstein | 2/202 |
| 5,367,706 | 11/1994 | Davidson | 2/202 |

FOREIGN PATENT DOCUMENTS

| | | | |
|---|---|---|---|
| 953456 | 12/1949 | France | 2/202 |
| 1165524 | 10/1958 | France | 2/202 |

*Primary Examiner*—Amy B. Vanatta

[57] ABSTRACT

A transport hood is provided to protect conveying personnel, such as law enforcement personnel, from contact with blood and body fluids issued by a detainee. The transport hood acts as a barrier between the blood and body fluids of the detainee and the surrounding environment to protect personnel who transport, or convey, the detainee while in custody from being infected with communicable diseases, such as HIV and AIDS. The transport hood includes a top portion and a bottom portion. The top portion is made of a fine plastic or fabric mesh which is transparent. The bottom portion is made of a plastic or fabric cloth which is impervious to the bacteria, blood and body fluids issued by the detainee. A first length of elastic joins the top portion to the bottom portion and gathers the top portion of the hood just below the eyes of the detainee. A second length of elastic may be sewn into the lowermost seam of the bottom portion of the hood to secure the hood around the neck of the detainee without restricting the breathing or comfort of the detainee.

5 Claims, 2 Drawing Sheets

TRANSPORT HOOD FOR PROTECTING CONVEYING PERSONNEL

BACKGROUND OF THE INVENTION

1. Field of the Invention

The invention relates to a protective head covering, and more particularly, to a transport hood for protecting conveying personnel from the body fluids of a detainee.

2. Description of the Prior Art

Each year, the number of detainees who are infected with the Human Immune Virus (HIV), Acquired Immune Deficiency Syndrome (AIDS) and other communicable diseases increases dramatically. The transportation of detainees, such as prisoners, invariably results in moments of high stress, duress and emotion. During these moments, the detainee may resist the conveying personnel, and thus become injured to the extent that the detainee bleeds. In addition, the detainee may intentionally or accidently issue body fluids, such as spit, onto the conveying personnel. Accordingly, personnel who convey detainees must take care to avoid contact with the detainee's body fluids.

Protective head coverings, known as transport hoods, have long been utilized to constrain detainees, and to protect the conveying personnel from the detainee as well as to protect the detainee from the surrounding environment. However, prior transport hoods include a discrete opening adjacent the eyes of the detainee. Thus, conveying personnel are required to take additional time to orient the opening provided in the transport hood with the eyes of the detainee. The additional time that the conveying personnel are in close proximity to the detainee increases the risk that the conveying personnel will come in contact with the body fluids of the detainee. Further, the discrete opening restricts the vision of the detainee and prevents the conveying personnel from observing the head of the detainee from any angle.

A prior art protective head covering is disclosed in U.S. Pat. No. 1,186,703 to Sullivan. Sullivan discloses a protective head covering, or hood, for use by an operator of a baling press or threshing machine. The Sullivan hood shields the head, eyes, nose, mouth and neck of the operator from dust and small particles of debris, such as straw. However, the Sullivan hood is not intended to prevent bacteria, blood and body fluids from the operator from being spread into the surrounding environment, and includes a pair of discrete openings that must be oriented adjacent the eyes of the operator.

U.S. Pat. No. 4,589,408 to Singer discloses a protective head covering for use as a surgical mask and hood. The Singer mask and hood protects the wearer from bacteria, blood and body fluids in the surrounding environment, and prevents bacteria, blood and body fluids issued by the wearer from being spread into the surrounding environment. However, the Singer mask and hood likewise includes a discrete opening that must be oriented with the eyes of the wearer, and does not permit the head of the wearer to be observed from any angle.

As is now apparent, a transport hood for protecting conveying personnel from the blood and body fluids of a detainee is needed that prevents blood and body fluids issued by the detainee from being spread into the surrounding environment, and which does not include a discrete opening that must be oriented with the eyes of the detainee. The present invention, as described in detail herein, provides a transport hood that protects conveying personnel from the detainee's blood and body fluids, while permitting the detainee unrestricted vision and the conveying personnel unrestricted observation of the detainee from any angle.

SUMMARY OF THE INVENTION

The invention is a transport hood used to cover the head of a person who is being detained, such as a prisoner being held in custody by law enforcement personnel. Such detainees are subject to carrying, and possibly spreading, bacteria, pathogens, and infectious and contagious diseases which are communicated through contact with blood or body fluids. The transport hood acts as a barrier between the blood and body fluids of the detainee and the surrounding environment to protect personnel who transport, or convey, the detainee while in custody.

The hood includes a top portion and a bottom portion each constructed of a different material. The top portion is substantially transparent. The bottom portion is made of a breathable plastic or fabric cloth which is impervious to blood and body fluids issued by the detainee.

The top portion of the transport hood covers the head of the detainee from just below the eyes of the detainee upwards. The bottom portion of the transport hood covers the head and neck of the detainee from just below the eyes of the detainee downwards. The top portion is preferably joined to the bottom portion by a first length of elastic which may be sewn into the hood so that the top and bottom portions are not easily torn apart under normal wear and use. The first length of elastic gathers the top portion of the hood to hold the hood securely on the head of the detainee, without being painful or particularly restraining.

The bottom portion of the transport hood may be provided with a second length of elastic which is preferably sewn into the lowermost seam of the bottom portion of the hood. The second length of elastic is long enough to allow the transport hood to be stretched easily over the head of the detainee, while securing the hood around the neck of the detainee without restricting the breathing or comfort of the detainee.

The invented transport hood protects conveying personnel from the detainee's blood and body fluids. The transport hood will not inhibit the detainee's breathing or vision, and cannot be easily removed by the detainee when his or her arms are restrained. Further, the transport hood permits the conveying personnel to observe the head of the detainee from any angle. If desired, the transport hood may be disposable to ensure that the blood and body fluids from one detainee are not spread to another detainee.

Although the use of rubber gloves is now mandatory for most conveying personnel, gloves protect only the hands of the conveying personnel from coming in contact with the detainee's blood and body fluids. The invented transport hood prevents the blood and body fluids which issue from the nose, mouth and head of the detainee from being communicated to the conveying personnel. Accordingly, the present invention substantially reduces the risk that law enforcement personnel may be infected with communicable diseases, such as HIV and AIDS, spread through contact with the detainee's blood and body fluids.

BRIEF DESCRIPTION OF THE DRAWINGS

The following is a brief description of the accompanying drawings of the invention.

DETAILED DESCRIPTION OF THE PREFERRED EMBODIMENT

Figure 1:
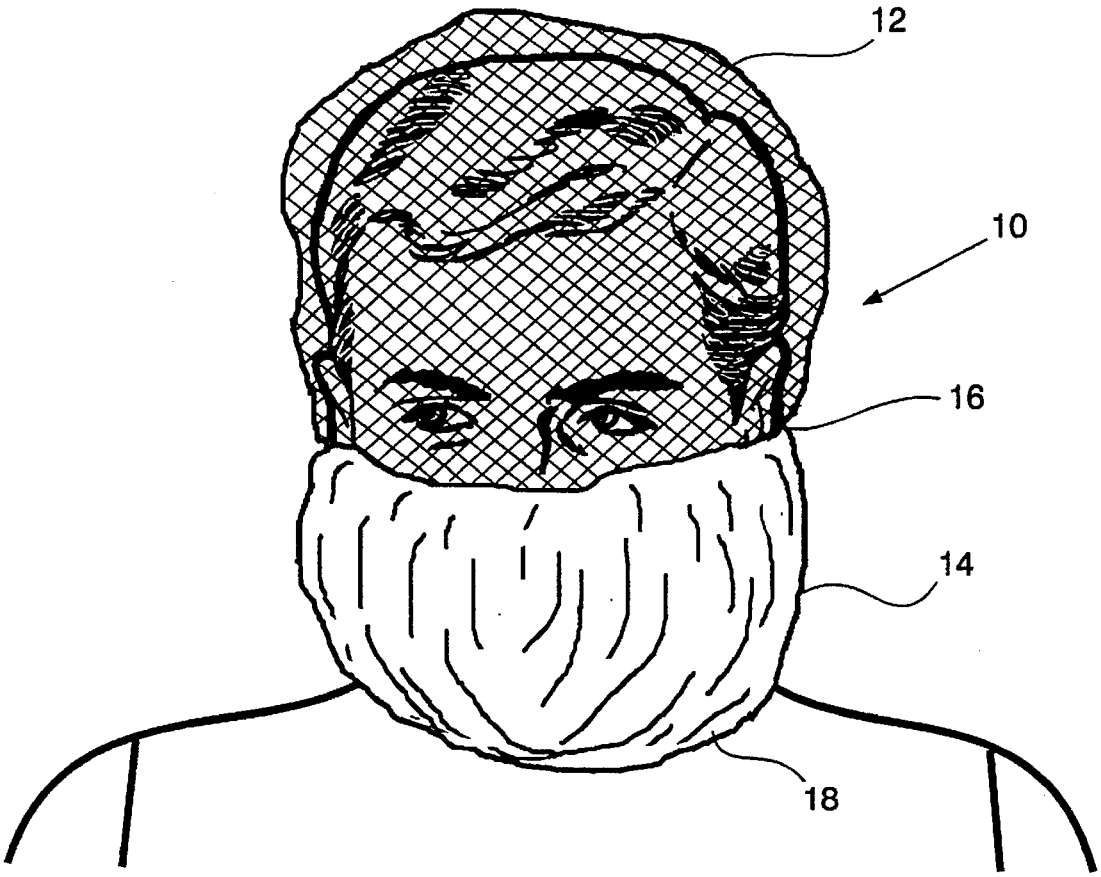
FIG. 1 is a perspective view of a preferred embodiment of a transport hood according to the invention shown on the head of a detainee.
Figure 2:
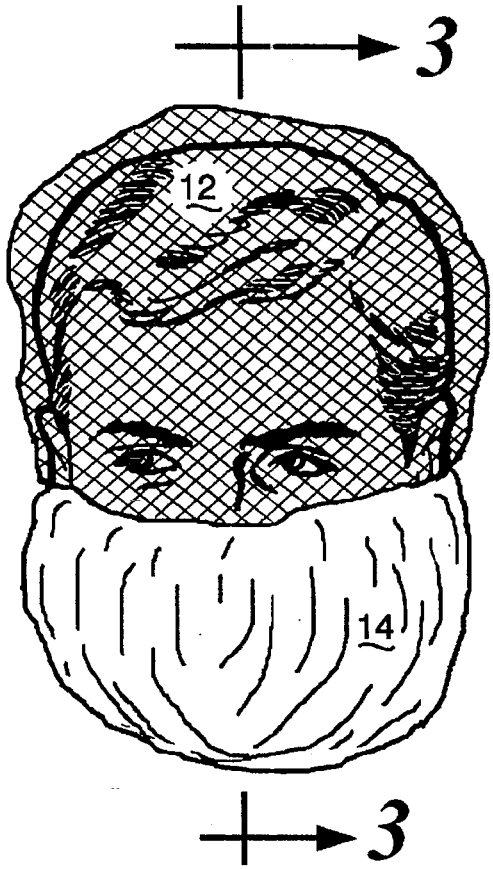
FIG. 2 is a side view of the transport hood of FIG. 1.

Referring now more specifically to the drawings, FIG. 1 is a perspective view of a protective head covering, or transport hood, 10 according to the invention. The transport hood 10 is generally dome shaped, and thus symmetric about its longitudinal axis. The hood 10 comprises a top portion 12, a bottom portion 14, a first length of an elastic material 16 and a second length of elastic material 18. The transport hood 10 is preferably placed over the head of a detainee, such as a prisoner, to protect conveying personnel, such as law enforcement personnel, from contact with the detainee's blood and body fluids.

As illustrated in FIG. 1, the top portion 12 covers the head of the detainee from the center of the nose area just below the eyes of the detainee upwards. The top portion 12 is substantially transparent. The size of the openings provided in the mesh 13 are large enough not to inhibit the vision or breathing of the detainee, but are not large enough to allow the detainee to easily remove the transport hood 10.

As illustrated in FIG. 1, the bottom portion 14 covers the head of the detainee from the center of the nose area just below the eyes of the detainee downwards. The bottom portion 14 is made of a breathable plastic or fabric cloth 15 (FIG. 3) which is impervious to bacteria borne by blood and body fluids that are issued by the detainee. Preferably, the cloth 15 is a polypropylene cloth of the type commonly used in medical and surgical apparel which includes additional properties to provide an effective barrier against pathogens borne by blood and body fluids. However, the cloth 15 is breathable so that it does not severely restrict the breathing or comfort of the detainee.

Figure 3:
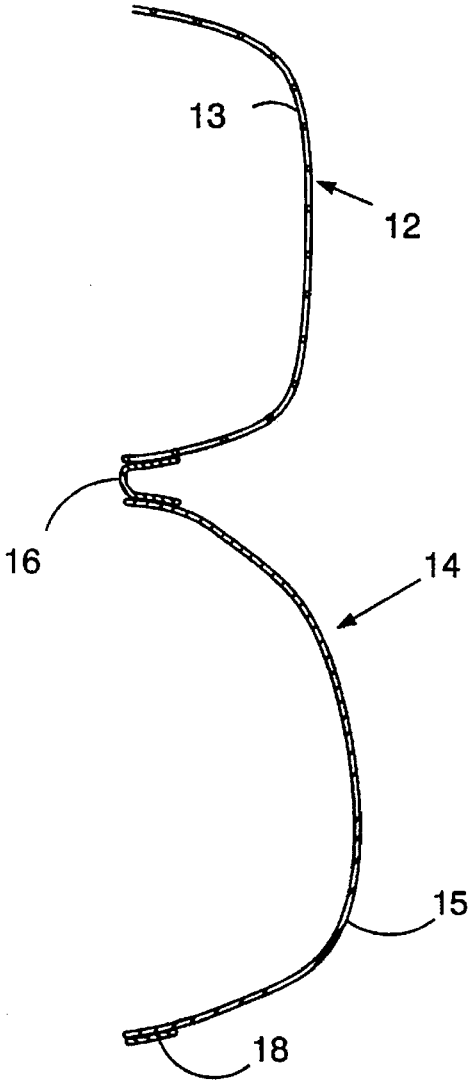
FIG. 3 is an enlarged cross sectional view of the transport hood of FIG. 1 taken along line 3—3 of FIG. 2.

As best shown in FIG. 3, the top portion 12 of the transport hood 10 is joined to the bottom portion 14 by a first length of elastic 16. The first length of elastic 16 is preferably sewn into the hood 10 so that the top portion 12 and bottom portion 14 are not easily torn apart under normal wear and use. The first length of elastic 16 gathers the top portion 12 of the hood 10 to hold the hood securely on the head of the detainee, without being painful or particularly restraining to the detainee.

As best shown in FIG. 3, the bottom portion 14 of the transport hood 10 may comprise a second length of elastic 18 which is preferably sewn into the lowermost seam of the bottom portion of the hood. The second length of elastic 18 is long enough to allow the transport hood 10 to be stretched easily over the head of the detainee, while securing the hood around the neck of the detainee without restricting the breathing or comfort of the detainee.

I claim:

1. A transport hood for protecting conveying personnel from blood and body fluids expelled by a detainee, said transport hood comprising:

a dome shaped top portion made of a fine mesh which is substantially transparent and extends around the entire periphery of the transport hood; and a bottom portion made of a breathable cloth which is impervious to blood and body fluids expelled by the detainee;

wherein said top portion is joined to said bottom portion by a first length of elastic which extends around the outer periphery of the transport hood for gathering a lowermost edge of said top portion just below the eyes of the detainee; and wherein said top portion provides the detainee with substantially unrestricted vision and breathing and permits the conveying personnel to observe the head of the detainee from any angle.

2. A transport hood according to claim 1 wherein said first length of elastic is sewn to the lowermost edge of said top portion and to an uppermost edge of said bottom portion.

3. A transport hood according to claim 1 wherein said bottom portion comprises a second length of elastic adjacent a lowermost edge of said bottom portion for securing the transport hood about the neck of the detainee without severely restricting the breathing and comfort of the detainee.

4. A transport hood according to claim 3 wherein said second length of elastic is sewn to the lowermost edge of said bottom portion.

5. A transport hood according to claim 1 wherein said bottom portion is made of polypropylene cloth which provides a barrier against pathogens borne by the blood and body fluids of the detainee.

* * * * *